US006379199B1

(12) United States Patent
Chen

(10) Patent No.: US 6,379,199 B1
(45) **Date of Patent: *Apr. 30, 2002**

(54) FEMALE TERMINAL FOR A CONNECTOR AND A HOUSING THEREFOR

(75) Inventor: Ping Chen, Mundelein, IL (US)

(73) Assignee: Japan Solderless Terminal Mfg. Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,582

(22) Filed: Sep. 9, 1999

(30) Foreign Application Priority Data

Sep. 11, 1998 (JP) ..... 10-276528
Jul. 1, 1999 (JP) ..... 11-188220

(51) Int. Cl.[7] ..... H01R 11/22
(52) U.S. Cl. ..... 439/852; 439/451
(58) Field of Search ..... 434/852, 853, 434/854, 855, 856, 857, 858, 842, 843, 844, 845, 848, 849, 850, 851

(56) References Cited

U.S. PATENT DOCUMENTS

| | | | | | |
|---|---|---|---|---|---|
| 3,268,851 | A | * | 8/1966 | Mancini | 439/857 |
| 3,836,947 | A | | 9/1974 | Yeager | 439/852 |
| 4,431,256 | A | * | 2/1984 | Piscitelli et al. | 439/843 |
| 4,448,477 | A | * | 5/1984 | Gladd et al. | 439/851 |
| 4,540,233 | A | | 9/1985 | Saijo et al. | 439/845 |
| 4,834,681 | A | * | 5/1989 | Chaillot | 439/856 |
| 5,067,916 | A | * | 11/1991 | Denlinger et al. | 439/857 |
| 5,106,329 | A | * | 4/1992 | Maeshima et al. | 439/851 |
| 5,607,328 | A | * | 3/1997 | Joly | 439/852 |
| 5,653,613 | A | | 8/1997 | Shimoda | 439/752 |
| 5,685,746 | A | | 11/1997 | Maejima | 439/845 |
| 5,735,717 | A | * | 4/1998 | Nabeshima | 439/851 |
| 5,857,877 | A | * | 1/1999 | Hotea et al. | 439/787 |
| 5,897,405 | A | * | 4/1999 | Endo | 439/852 |
| 5,911,603 | A | * | 6/1999 | Mansutti | 439/748 |
| 6,024,612 | A | * | 2/2000 | Myer et al. | 439/852 |
| 6,045,415 | A | * | 4/2000 | May et al. | 439/852 |

FOREIGN PATENT DOCUMENTS

| | | |
|---|---|---|
| JP | 5-135819 | 6/1993 |
| JP | 8-106944 | 4/1996 |
| JP | 9-55246 | 2/1997 |
| JP | 9-232021 | 9/1997 |
| WO | 98/18181 | 4/1998 |

OTHER PUBLICATIONS

European Search Report dated Oct. 27, 2000.

Specification and Drawings for US Patent Application No. 09/348,393 (Japanese Patent Application Hei 10–219753).

* cited by examiner

*Primary Examiner*—Gary Paumen
*Assistant Examiner*—Ross Gushi
(74) *Attorney, Agent, or Firm*—Nixon Peabody LLP; Donald R. Studebaker

(57) ABSTRACT

A female terminal for a connector wherein a leaf spring is provided inside the terminal proper. The front half of the terminal proper is provided with a bottom wall, side walls rising from both ends, in the direction of width, of the bottom wall, an outer upper wall and an inner upper wall extending from the upper edges of side walls to the upper edges of the opposing side walls. A leaf spring is formed by separating said rear inner upper wall from said side walls, with the rear end of said rear inner upper wall being left intact. A bead with a curved section is formed on the leaf spring to increase the flexural rigidity. The female terminal can be compactified, and a sufficient contacting force can be provided reliably. The contacting part of the leaf spring can be shifted forward. The developed shape can be made smaller. The bending steps can be reduced.

19 Claims, 18 Drawing Sheets

1

T

T

FEMALE TERMINAL FOR A CONNECTOR AND A HOUSING THEREFOR

BACKGROUND OF THE INVENTION

1. Field of the Invention

The present invention belongs to a technical field of a connector wherein a female terminal is inserted in a chamber of a housing.

2. Related Art

A connector has been known, as shown in FIG. 17A, wherein through chambers 82, in several rows and columns in the directions of height and width, are formed in a housing 81 in parallel to each other, a female terminal 84 being approximately box-shaped in the front half, thus having an approximately rectangular section, and being connected to an electric wire 83 in the back is inserted into and fixed in each of the chambers 82, and male terminals of a counterpart connector are inserted into these female terminals 84 to make mechanical connections as well as electrical connections (refer to, for example, Japanese Provisional Patent Hei 8-106944). A port 85 opens in the top end of the above-mentioned female terminal 84 to receive a male terminal. A splicing part 86 is formed in the back of the female terminal 84 to connect an electric wire 83. A concave fixing part 87 is formed in an intermediate part of the female terminal 84. A hook of a lance 88 that is flexibly formed in a chamber 82 of the housing 81 fits into this concave fixing part 87 to make a primary fixing of the female terminal 84 to the housing 81. Moreover, a fixing piece 90 of a retainer 89 that is fitted into the housing 81 is set at the back of a stabilizer 91 that is formed on the top of the intermediate part of the female terminal 84 to make a secondary fixing of the female terminal 84 to the housing 81.

Apart from this, a connection structure between a female terminal of this kind and a male terminal has been disclosed in Japanese Provisional Patent Hei 9-232021. As shown in FIG. 17B, to hold an inserted male terminal 92', a leaf spring 93' is integrally formed inside the terminal proper 94' of a female terminal 84'. Moreover, a separate reinforcing leaf spring 95' is blanked out together with the terminal proper 94' and this reinforcing leaf spring 95' is bent on the inner side of the main leaf spring 93' to form double springs and ensure a sufficient contacting force.

Further, in Japanese Provisional Patent Hei 5-135819, a female terminal has been disclosed wherein a leaf spring is integrally formed inside the terminal proper and the leaf spring is bent sideways and approximately circularly to form a round part. The front half of this terminal proper is formed into an approximately box-shaped form that comprises a bottom wall, side walls rising from both ends, in the width direction, of the bottom wall, and an outer upper wall and an inner upper wall which extend from the top ends of the respective side walls towards the top ends of the opposing side walls and overlap with each other above and below. As the terminal proper is formed into an approximately box-shaped form having upper walls overlapping with each other, it has merits that the above-mentioned front half is hardly deformed even if, for example, a worker inadvertently steps on it and external forces are exerted to the terminal proper and that the leaf spring inside the terminal proper is protected reliably.

However, in the above-mentioned female terminal 84' having double springs, as two leaf springs 93', 95' overlap with each other, the female terminal 84' becomes bulkier in the direction of height, preventing compactification of the connector. Further, the female terminal having a round part being bent sideways into an approximately circular arc becomes bulkier in the direction of width due to this round part, preventing compactification of the connector.

In the case of the female terminal 84' having double springs, as each of the leaf springs 93', 95' is formed by bending, a gap is formed between two unrestricted leaf springs due to springbacks. As the dimension of this gap is a cumulative result of steps of forming two springs, it is difficult to accurately control this dimension in the production. Hence it is hard to avoid dispersion in this gap dimension. This poses a problem. At the time of use, the point of inflection of the spring constant at which the main spring 93' contacts the reinforcing spring 95' and both springs 93', 95' start to be deformed varies from product to product. Thus contacting forces are not stable and vary from product to product.

When a female terminal is blanked out of a sheet metal and shaped into a desired form by bending, the smaller is the developed shape of the female terminal, the greater is the efficiency of yielding the developed shapes of the terminal from a material of a given area, thus the cost is lowered. Furthermore, the smaller is the number of bending operations, the simpler is the process of production. This also contributes to reduction in cost.

As a connector is used in combination with a counterpart connector, compactification of the counterpart connector is also desired. Further, if there is an error in assembling a male terminal in the counterpart connector, the male terminal may be assembled to be slightly slant in relation to the housing. In the worst case, such a male terminal may cause a trouble that it can not be inserted into a female terminal.

The above-mentioned stabilizer 91 can exhibit a function of preventing so-called inverse insertion; if the female terminal 84 is inserted into the chamber 82 of the housing 81 in an incorrect orientation, for example, upside down, the stabilizer 91 will catch the entrance of the chamber 82 to prevent further insertion. Because of this function, the female terminal 84 and the retainer 89 are brought to a proper positional relationship and the female terminal 84 is fixed by the retainer 89. However, as the stabilizer 91 is to be fixed by a fixing piece 90 of the retainer 89, the stabilizer 91 is provided on the top of the intermediate part of the terminal proper. Accordingly, the front portion of the terminal proper ahead of the stabilizer 91, even if it is inverted upside down, would be inserted. This, in turn, would make the worker forcefully insert the female terminal 84 further, resulting in a damage to the chamber and nearby of the housing 81.

When a continuity test or the like is given to a female terminal of a connector, a test jig having a shape identical to that of a male terminal is inserted into the female terminal. When the test jig is used repeatedly, the jig may be deformed. If such a deformed jig is forced into a female terminal, the lead spring, etc. will be damaged to cause a trouble.

SUMMARY OF THE INVENTION

In view of the above-mentioned problems, the present inventor has proposed, in Patent Application No. Hei 10-219753, an invention to solve some problems. That invention, however, has limitations to compactification of the connector and the developed shape of the connector since the leaf spring has a round part and the round part is provided independently of a wall constituting the front half of the terminal proper. Accordingly, one objective of the present invention is to form the front half of a terminal proper into an approximately box-shaped form so as to protect a leaf spring, etc., to use an upper wall so as to form a leaf spring, to form a bead on the leaf spring so as to reduce the number of leaf spring to one and compactify the female terminal in both the directions of height and width as much as possible, to secure sufficient contacting force reliably and move a contacting part of the leaf spring forward, to reduce the length of insertion of a male terminal so as to compactify the counterpart connector and increase the tolerance of the connector to slant of the male terminal, to make the developed shape of the female terminal smaller so as to achieve efficient use of material, reduce the costs and simplify the production process.

To accomplish the above-mentioned objective, the present invention is a female terminal for a connector that is to be inserted into a chamber of a housing of a connector and is to receive a male terminal, said female terminal comprising: a terminal proper having a box-shaped front half that can be inserted into said chamber of the housing, having a port that opens in the front end and receives a male terminal, and having a splicing part that is in the back and is to be connected to an electric wire; and a leaf spring having a root end that is integral to the front half of said terminal proper, having a top end that extends forward inside the front half of said terminal proper, and being to be flexed in the direction of height; said front half of the terminal proper comprising a bottom wall, side walls rising from both ends in the width direction of said bottom wall, and an outer upper wall and an inner upper wall extending from the top edges of said respective side walls toward the top edges of the opposing side walls, said inner upper wall having a front inner upper wall and a rear inner upper wall, said leaf spring being formed by separating said rear inner upper wall from the side wall, with the rear end of said rear inner upper wall being left intact, and said leaf spring having a bead with a curved section to increase the flexural rigidity.

According to the present invention, an electric wire is connected to the splicing part of the terminal proper, and the female terminal is inserted into a chamber of the housing. When this connector is opposed to a counterpart connector and the male terminals of the counterpart connector are inserted into the respective female terminals of the connector, the leaf springs will be pressed to contact the male terminals to make mechanical connections and electric connections between both connectors.

In this case, as the front half of the terminal proper is formed into an approximately box-shaped form, the front half will be hardly deformed, thus the leaf spring, etc. inside the front half will be protected reliably. Further, as a bead is formed on the leaf spring, the flexural rigidity of the leaf spring is increased and a sufficient contacting force can be provided by a single leaf spring without provision of a reinforcing spring. Moreover, as the female terminal does not have any reinforcing spring nor a round part, the female terminal can be compactified in both directions of height and width. Further, as no reinforcing spring is provided, the spring constant has no point of inflection, and the contacting force of each product is stabilized. Furthermore, as the flexural rigidity of the leaf spring is increased, a sufficient contacting force is generated even if a contacting part of the leaf spring is shifted forward close to the port. As a result, the length of insertion of a male terminal is shortened, and in turn, the housing of the counterpart connector that contains the male terminal is shortened and compactified and its tolerance to slant of the male terminal is also increased. Moreover, as the leaf spring is made out of the inner upper wall, the developed shape is smaller in comparison with a case when a leaf spring is provided independently, and in turn, the efficiency of layout of developed forms is improved and the cost is reduced, and furthermore, as bending steps dedicated to the leaf spring are eliminated, the production process is simplified.

In the female terminal for a connector according to the present invention, the front half of the terminal proper is formed into an approximately box-shaped form to protect a leaf spring, etc., and a leaf spring is made out of the inner upper wall and a bead is formed on the leaf spring to increase its rigidity. As a result, the number of leaf spring is reduced to one, the female terminal can be compactified in both directions of height and width, a sufficient contacting force can be provided reliably, the contacting part of the leaf spring can be shifted forward, the length of insertion of the male terminal can be shortened and the counterpart connector can be compactified, and the tolerance to slant of the male terminal is increased and the yield of connectors can be improved. Moreover, the developed shape can be made smaller to improve the efficiency of layout of developed shapes and, in turn, to reduce the costs, and the bending steps dedicated to the leaf spring can be eliminated to simplify the production process.

PREFERRED EMBODIMENTS OF THE INVENTION

Figure 1:
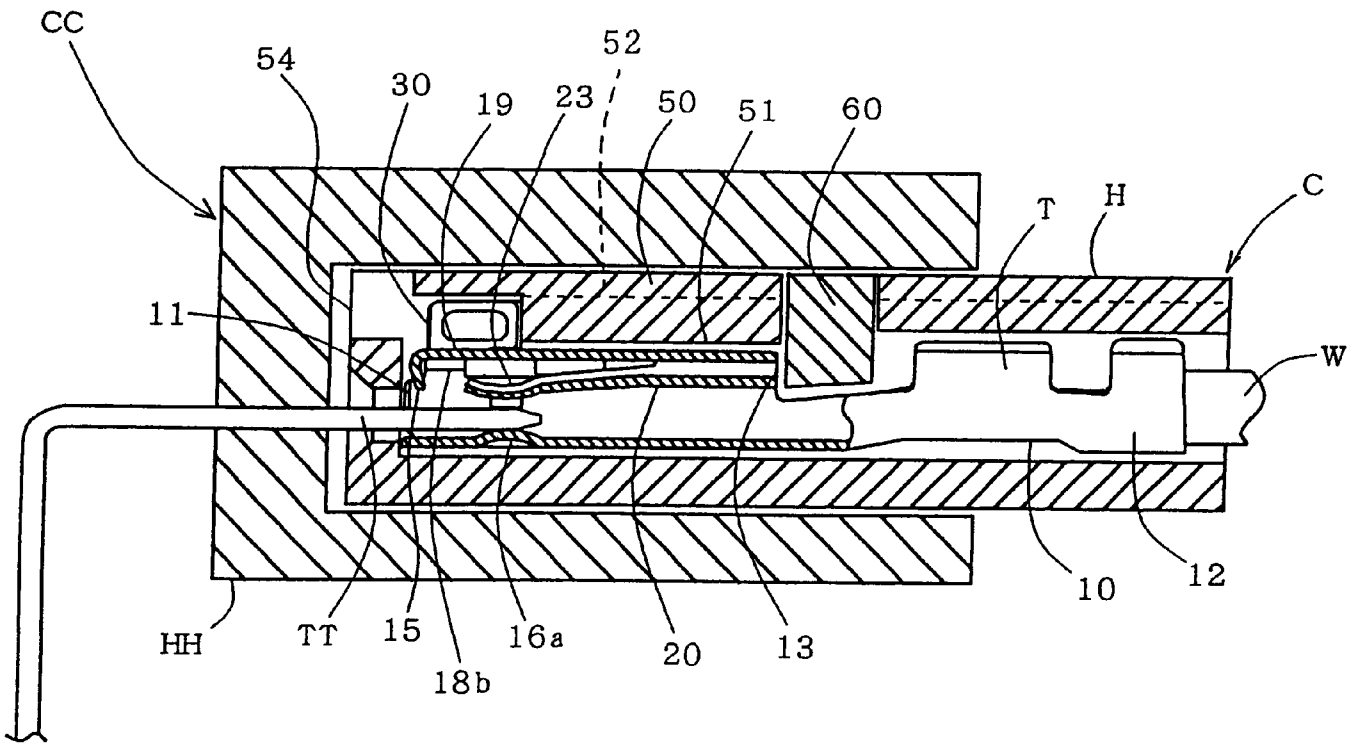
FIG. 1 is a fragmentary vertical sectional view showing a connector of the first embodiment being connected with a counterpart connector.
Figure 2:
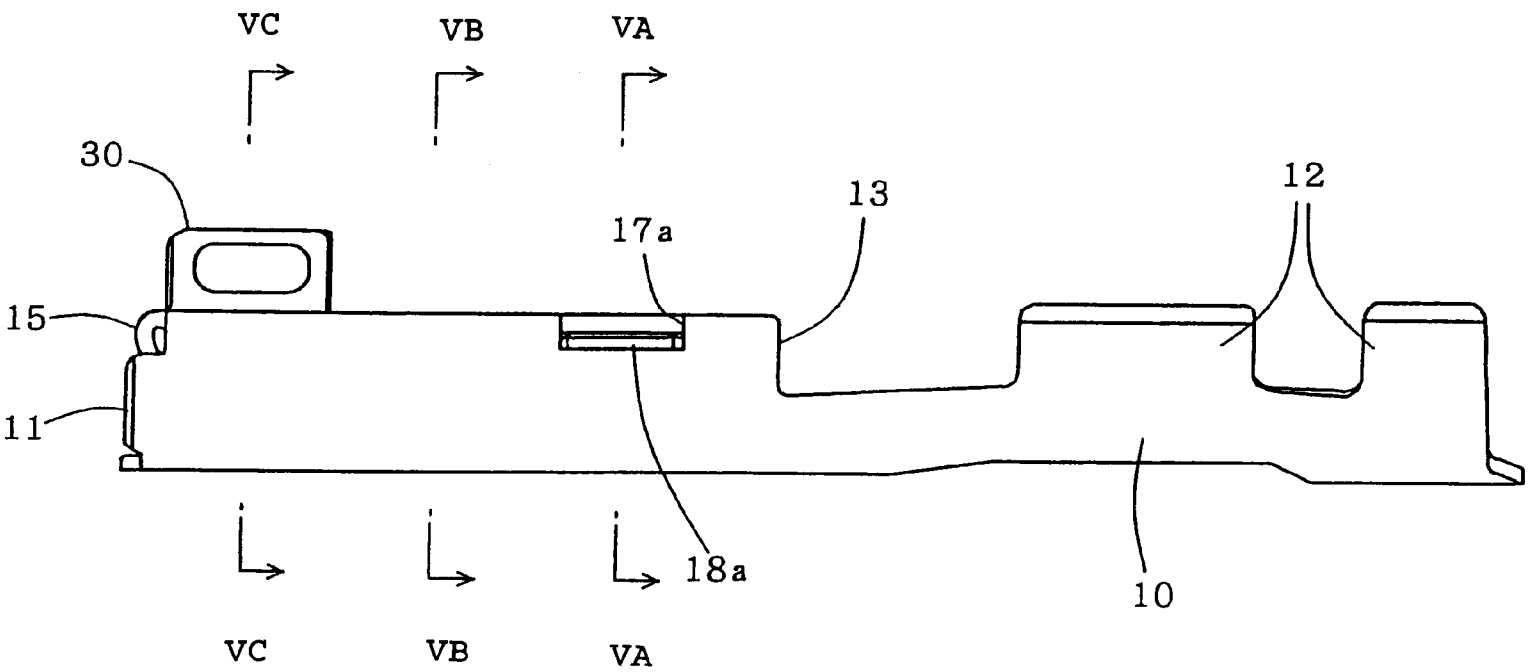
FIG. 2 is a right side view of the female terminal of the first embodiment.
Figure 3:
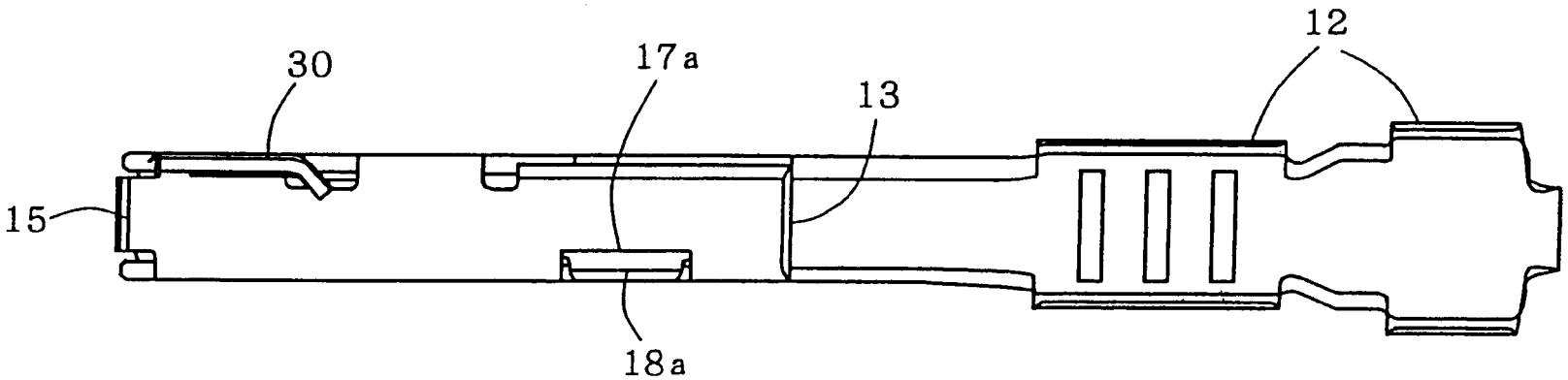
FIG. 3 is a plan view of the female terminal of the first embodiment.
Figure 4:
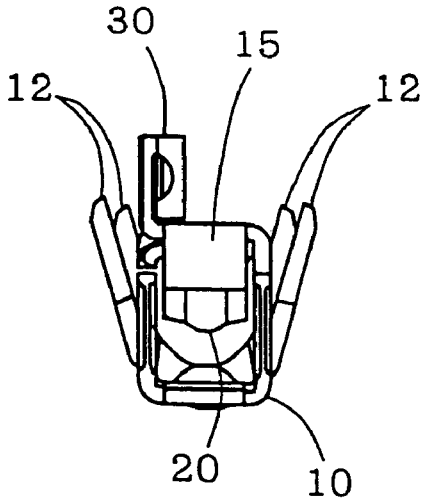
FIG. 4 is a front view of the female terminal of the first embodiment.
Figure 5A:
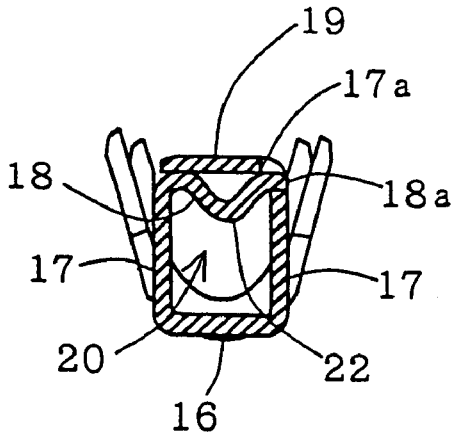
FIG. 5A is a sectional view along the line VA—VA of FIG. 2.
Figure 5B:
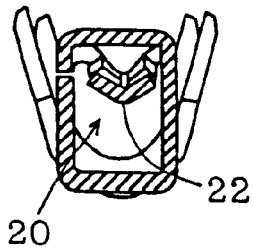
FIG. 5B is a sectional view along the line VB—VB of FIG. 2.
Figure 5C:
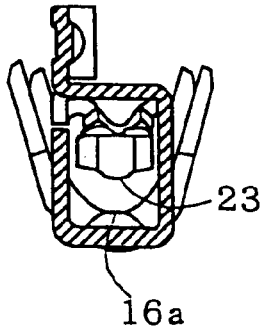
FIG. 5C is a sectional view along the line VC—VC of FIG. 2.
Figure 6:
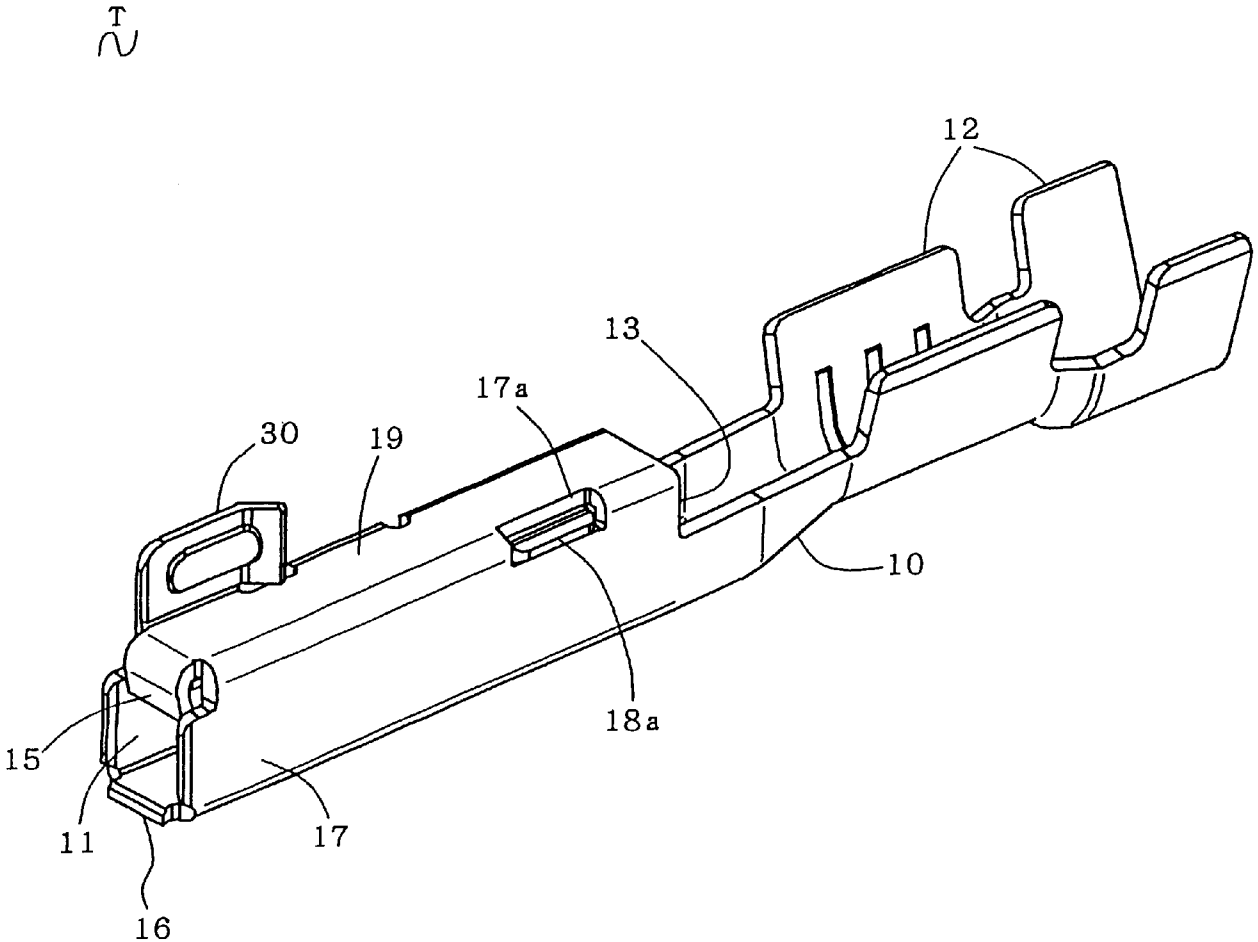
FIG. 6 is a perspective view showing the female terminal of the first embodiment seen at an angle from a point ahead and above.
Figure 7:
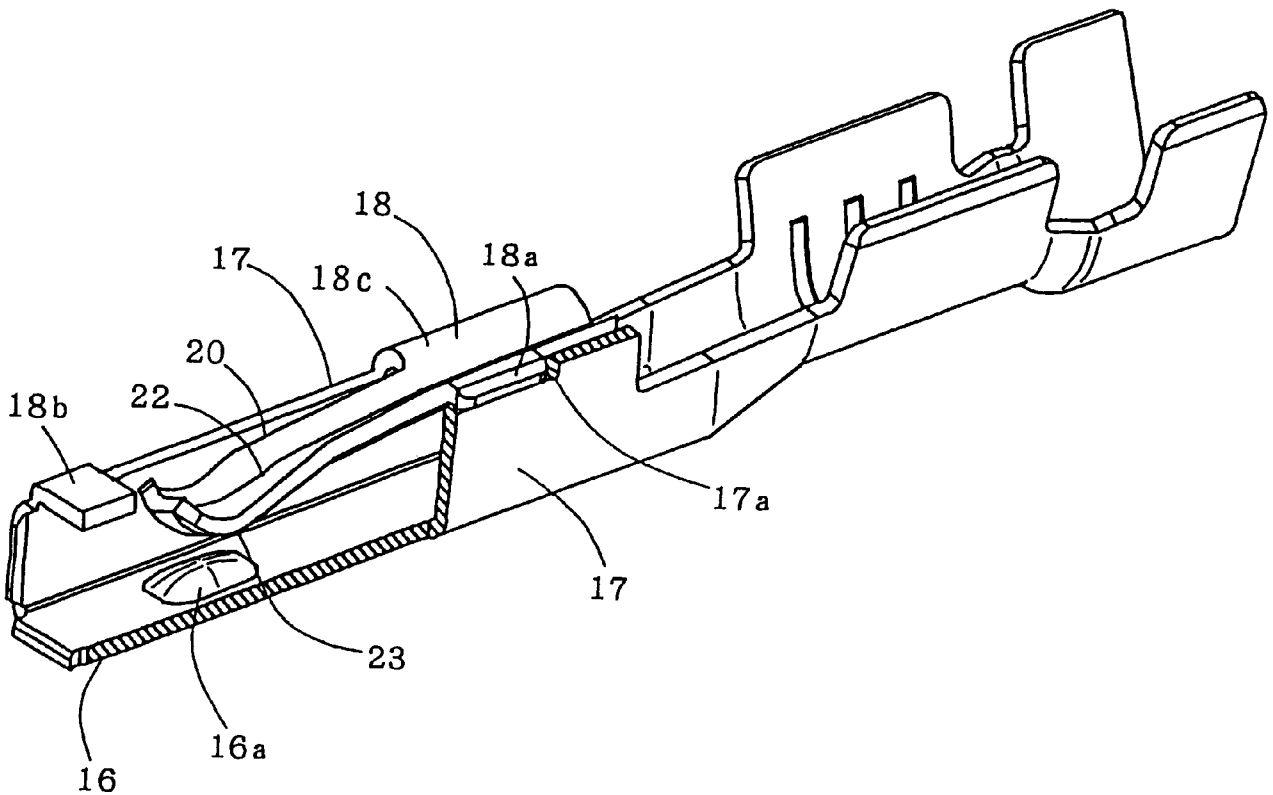
FIG. 7 is a perspective view of the female terminal of FIG. 6. The outer upper wall of the front half of the terminal proper and the side wall continuous to it are cut away.
Figure 9A:
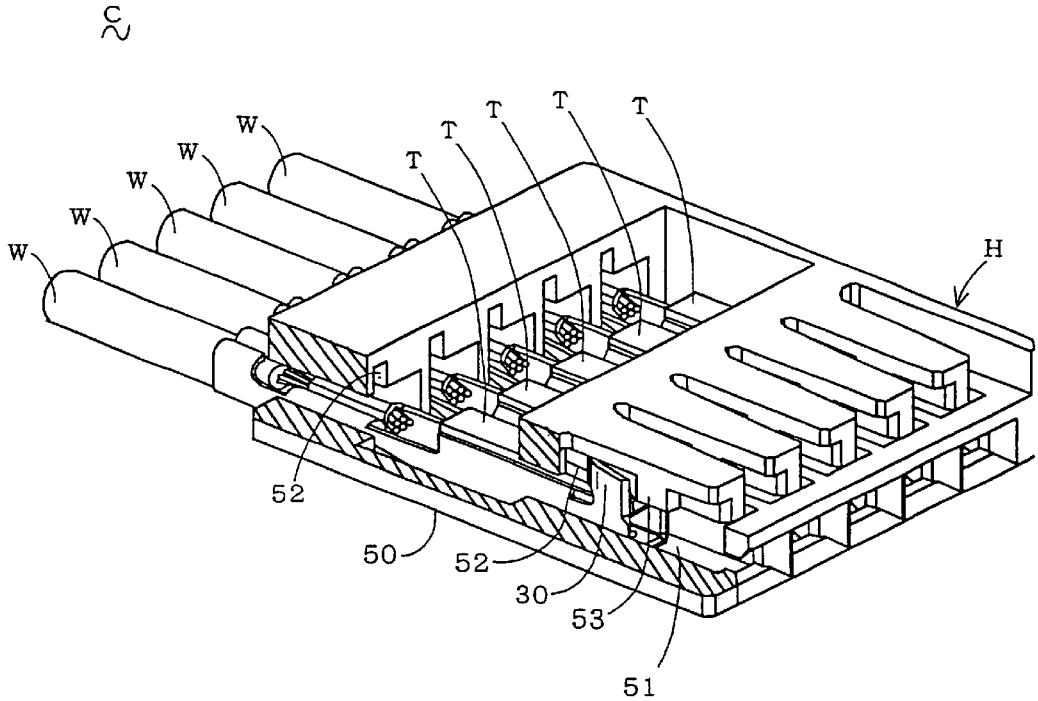
FIG. 9A is a perspective view of the female terminal of the first embodiment. The female terminal is being inserted into the housing. It is seen from a point in front, on the right and above. The retainer is not shown.
Figure 9B:
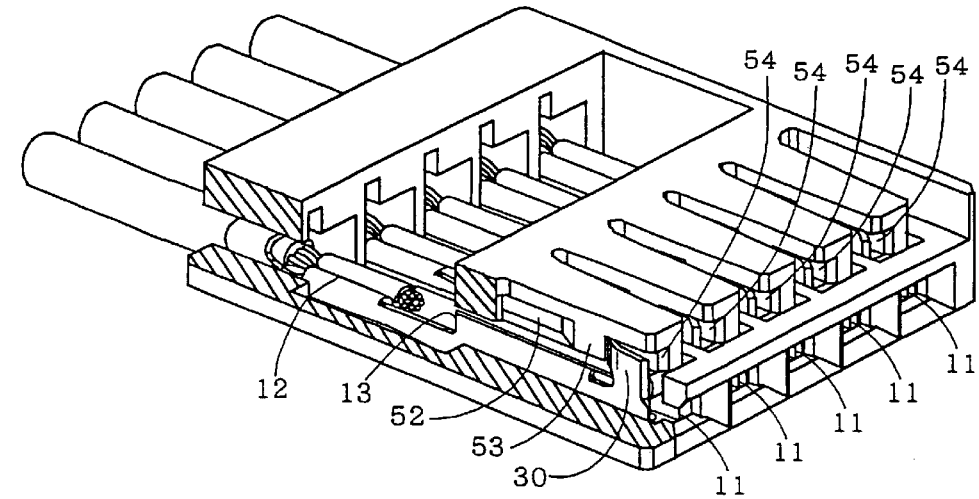
FIG. 9B is a similar perspective view of the female terminal after completion of insertion. In both diagrams, a part of the chamber on this side is cut away.
Figure 10:
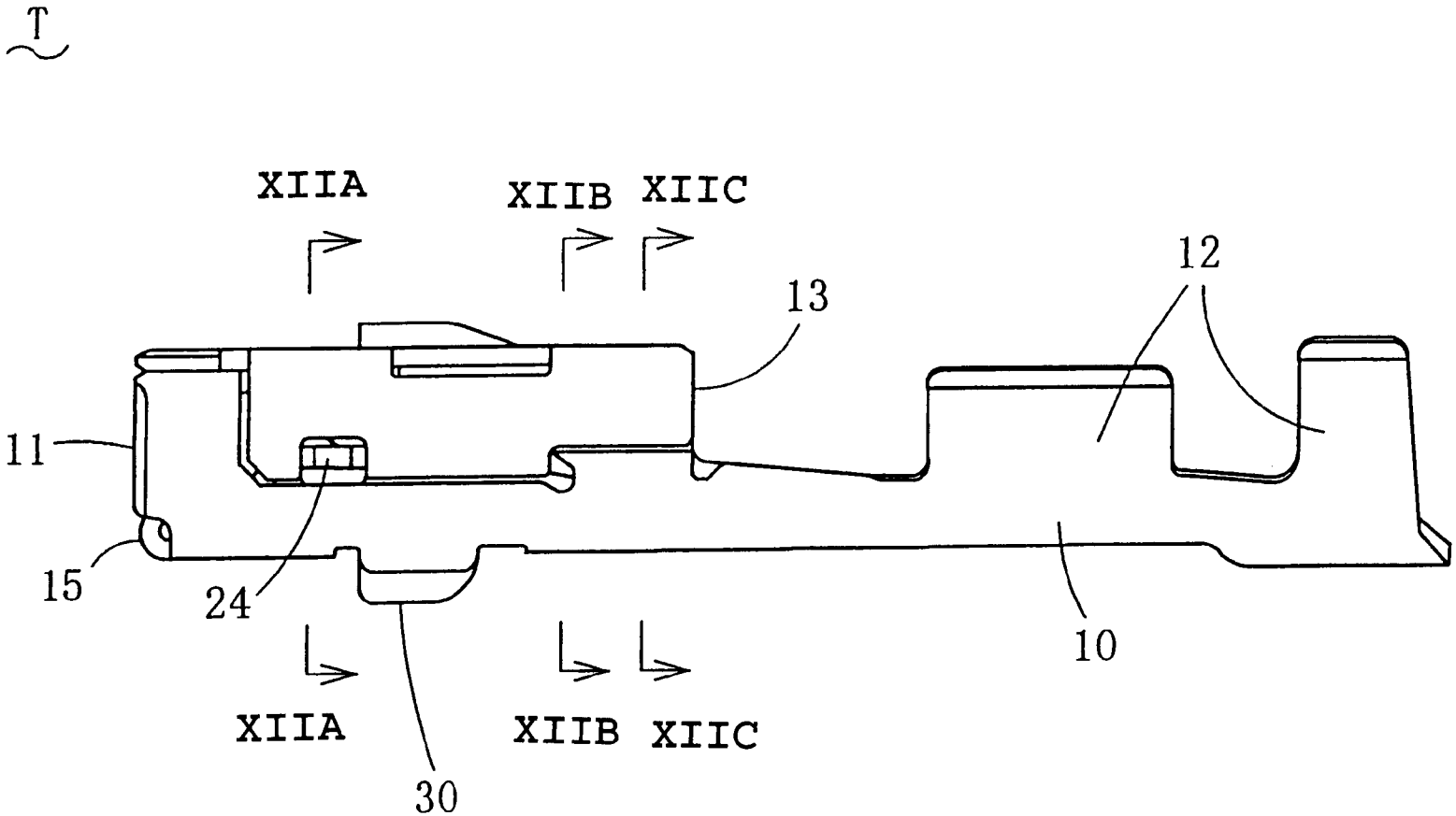
FIG. 10 is a right side view of the terminal of the second embodiment.
Figure 11:
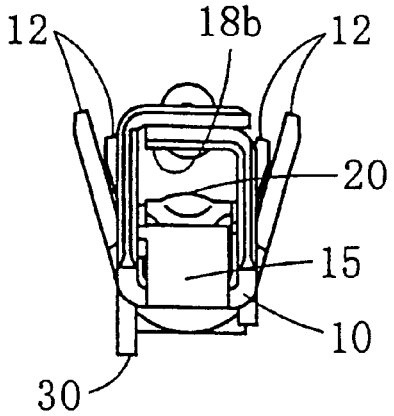
FIG. 11 is a front view of the terminal of the second embodiment.
Figure 12A:
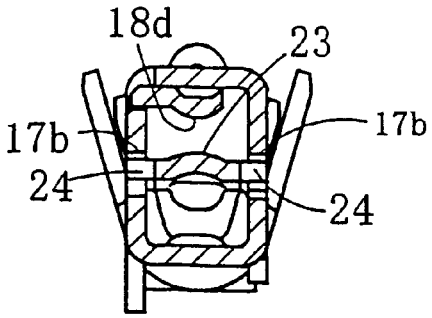
FIG. 12A is a sectional view along the line XIIA—XIIA of FIG. 10.
Figure 12B:
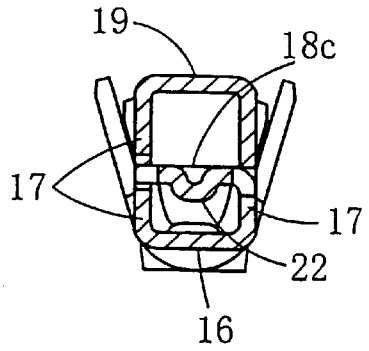
FIG. 12B is a sectional view along the line XIIB—XIIB of FIG. 10.
Figure 12C:
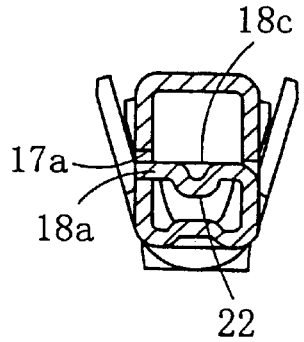
FIG. 12C is a sectional view along the line XIIC—XIIC of FIG. 10.
Figure 13:
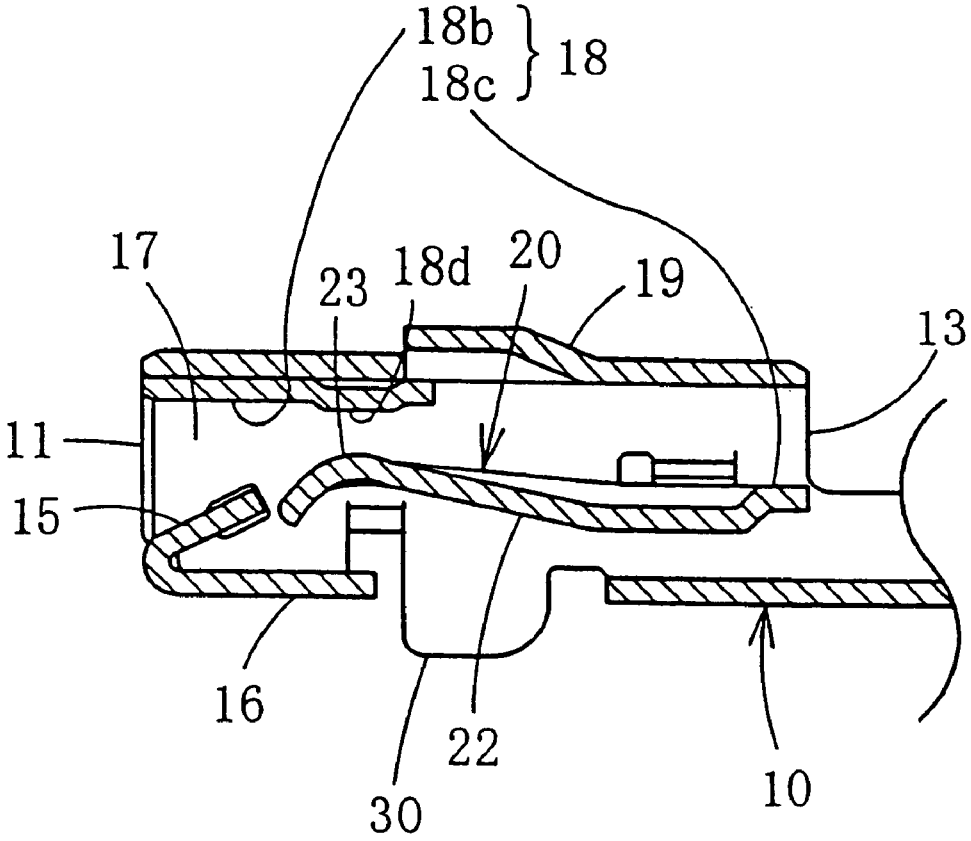
FIG. 13 is a diagram showing a vertical section of the front half of the terminal of the second embodiment seen from the right.
Figure 14:
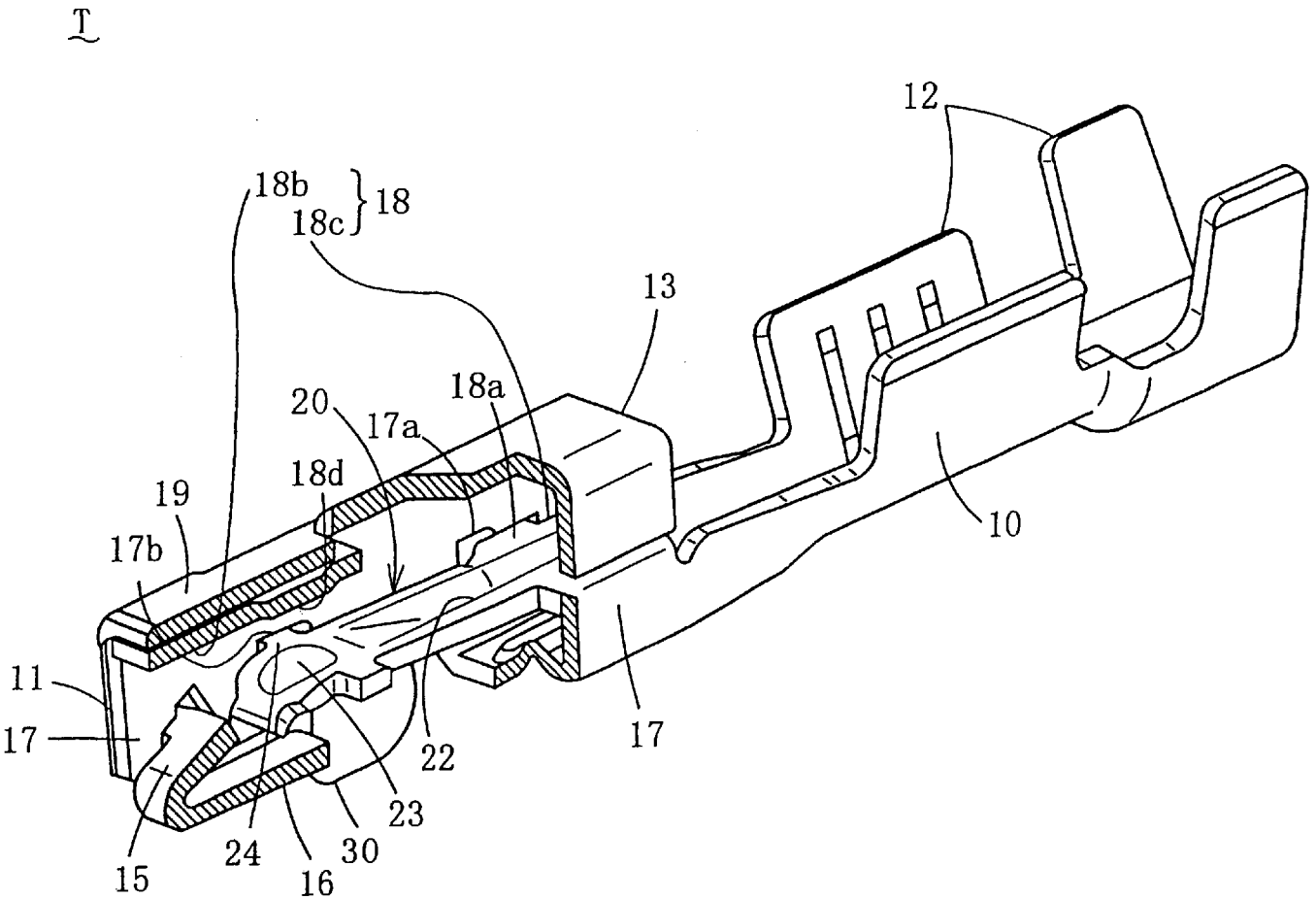
FIG. 14 is a perspective view of the terminal of the second embodiment seen at an angle from a point ahead and above. The front half of the terminal is cut away vertically.

In the following, embodiments of the present invention will be described with reference to the attached drawings. FIG. 2 through FIG. 7 show a female terminal T of a connector C of the first embodiment. FIG. 1, FIG. 9A and FIG. 9B show the connector C wherein this female terminal T is inserted in a housing H.

As shown in FIG. 2 through FIG. 6, this female terminal T is provided with a terminal proper 10 having an approximately box-shaped front half that can be inserted into a chamber 51 of the housing H, a leaf spring 20 of which root end is integral to the front half of the terminal proper 10, and a stabilizer 30 being on the outer side of the terminal proper 10. It should be noted here that with regard to the female terminal T, the front-rear direction is the longitudinal direction. For example, in FIG. 4, it is the direction perpendicular to the paper. The direction of height substantially corresponds to the direction of flexing of the top end of the leaf spring 20; for example, in FIG. 3, it is the direction perpendicular to the paper. The direction of width substantially corresponds to the direction of width of the top end of the leaf spring 20; for example, in FIG. 2, it is the direction perpendicular to the paper. This system of directions is also applied to the housing H. Hence the front-rear direction, the height direction and the width direction of the female terminal T that is inserted in the chamber 51 are the front-rear direction, the height direction and the width direction of the chamber 51 of the housing H, respectively. This system of directions is also followed in the second embodiment.

A port 11 is opened in the front end of the terminal proper 10 to receive a male terminal TT, and a splicing part 12 for connecting an electric wire W is provided in the back thereof. This splicing part 12 is formed to have, for example, an approximately U-shaped section. Its upper edge portions are bent inward to hold the conductor of the electric wire W by crimping, soldering, etc. A longitudinally intermediate part of the terminal proper 10 is provided with a fixing part 13 into which a retainer 60 of the housing H is to be fitted. This fixing part 13 is formed by, for example, cutting away small portions of the terminal proper at the back of the front half thereof. As shown in FIG. 1, the retainer 60 can be fitted into the fixing part 13.

The front half of the terminal proper 10 is provided with a bottom wall 16, side walls 17, 17 rising from both edges in the width direction of the bottom wall 16, and an outer upper wall 19 and an inner upper wall 18 extending from the upper edges of the respective side walls 17, 17 towards the upper edges of the respective opposing side walls 17, 17. The inner upper wall 18 is provided with a front inner upper wall 18*b* and a rear inner upper wall 18*c*, and the outer upper wall 19 and the front inner upper wall 18*b* overlap with each other, above and below. The rear inner upper wall 18*c* is formed at the same height as the front inner upper wall 18*b*, and a male terminal TT of a counterpart connector is to be inserted into a space between the leaf spring 20 and the bottom wall 16. Hence the front half of the terminal proper 10 is approximately box-shaped with the outer upper wall 19 and the inner upper wall 18 overlapping with each other; the front half of the terminal proper 10 is hardly deformed and protects the leaf spring 20 therein. The front end of the outer upper wall 19 is bent inward to the terminal proper 10 to conceal the front end of the inner upper wall 18 and form a guide 15. This guide 15 prevents inadvertent insertion of a male terminal TT, a screwdriver for inspection, etc. into a gap between the top end of the leaf spring 20 and the inner wall of the terminal proper 10.

As shown in FIG. 1, FIG. 5A, FIG. 5B, FIG. 5C and FIG. 7, the top end of the above-mentioned leaf spring 20 extends forward inside the front half of the terminal proper 10 and can be flexed in the height direction. When a male terminal TT is inserted, the top end of the leaf spring 20 will be above the male terminal TT and be pressed to contact the male terminal TT. The above-mentioned leaf spring 20 is formed by separating the rear inner upper wall 18*c* from the side wall 17, with the rear end of the rear inner upper wall 18*c* being left intact. Thus the leaf spring 20 is formed by a plate that is cut out of an intermediate part, in the front-rear direction, of the inner upper wall 18 into a strip of which rear end is left intact. This leaf spring 20 may be made to have the full width of the rear inner upper wall 18*c* or a portion of the full width in the direction of the width. A bead 22 that has a curved section to increase the flexural rigidity is formed on the leaf spring 20. Examples of the sectional forms of the above-mentioned bead 22 include approximately V-shaped form shown in the diagrams, approximately U-shaped form, approximately W-shaped form and their inverted forms. What is important is that when the leaf spring 20 is sectioned along a plane in the front-rear direction the moment of inertia of area along a neutral axis passing sidewise in the middle, in the thickness direction, of the leaf spring 20 is greater than that of a flat plate. The bead 22 may be formed over approximately the entire length of the leaf spring 20 as illustrated, or over a part of the overall length thereof. Further, the bead 22 may be formed into a groove as illustrated or a dimple or a combination of these forms. The root end of the leaf spring 20 is fixed to another wall. A thrusting piece 18*a* is formed on the side end of the rear of the inner upper wall 18 constituting the root end of the leaf spring 20, and this thrusting piece 18*a* is fit into a hole 17*a* that is opened in an area from the opposing side wall 17 to the outer upper wall 19. This hole 17*a* may be formed in only the side wall 17 or only the outer upper wall 19.

As shown in FIG. 1, FIG. 9A and FIG. 9B, when the terminal proper 10 is inserted into the chamber 51 of the housing H, the above-mentioned stabilizer 30 will fit into a groove 52 that is formed in the front-rear direction and moves forward beyond a lance 53 that is formed in the groove. The stabilizer 30 will reach a position in front of the lance 53 and will be fixed there by the lance 53. The stabilizer 30 having a face in the width direction is erected in the height direction at the front end of the terminal proper 10. In the first embodiment, the stabilizer 30 is provided on the upper side of the terminal proper 10, but it may be provided on the lower side thereof.

Figure 8:
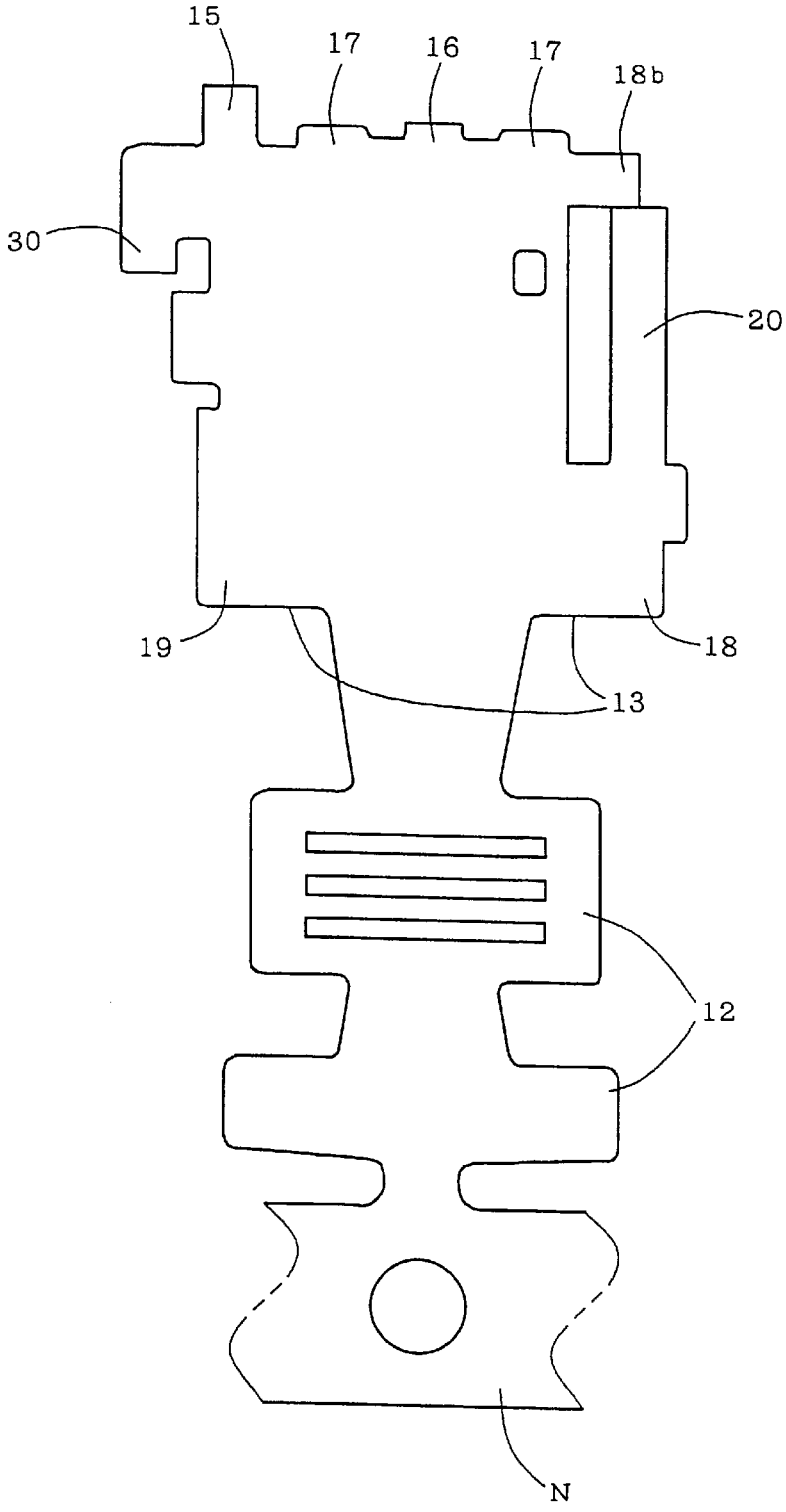
FIG. 8 is a reduced diagram showing the development of the female terminal of the first embodiment. The diagram shows the female terminal before bending.

The female terminal T is formed from a single sheet metal. As shown in FIG. 8, plural female terminals T, T . . . in a developed form, with a runner N connecting them together, are blanked out of a sheet metal. Next, various parts are bent to form the female terminals T, T . . . into the final shape. After that, the respective female terminals T are separated from the runner N.

On the upper side of the bottom wall 16 of the terminal proper 10 and on the lower side of the leaf spring 20, dimples 16*a*, 23 protruding towards each other are formed respectively to reliably provide contacting parts for the male terminal TT.

As shown in FIG. 1 through FIG. 4, FIG. 6, FIG. 9A and FIG. 9B, the above-mentioned housing H comprises a housing proper 50, in which through chambers 51 are formed in the front-rear direction, and a retainer 60 that fits into the housing proper 50 and penetrates into the chambers 51. The above-mentioned housing proper 50 is provided with grooves 52 that are made in the height direction from the chambers 51, extend in the front-rear direction and receive the stabilizers 30, lances 53 that are formed in respective grooves to be flexed in the width direction of the chambers 51 and fix the stabilizers 30 by the front sides, and testing windows 54 that allow access to the grooves 52 in front of the lances 53 from the front side. The above-mentioned grooves 52 are formed upward from the chambers 51. In FIG. 9A and FIG. 9B, the exemplifying housing of a connector C has a single row of parallel chambers 51 arranged in the width direction. However, the present invention includes an embodiment of a housing wherein such rows of chambers 51 are arranged in several columns in the height direction.

In the above-mentioned first embodiment, after an electric wire W is connected to the splicing part 12 of the terminal proper 10, when the female terminal T is inserted into a chamber 51 of the housing H, the stabilizer 30 will fit into a groove 52 of the housing H (the state shown in FIG. 9A), then the stabilizer 30 will go beyond a lance 53 of the housing H and will be fixed by the lance 53. This is the primary fixing of the female terminal T to the housing H (the state shown in FIG. 9B). Next, when the retainer 60 is forced into the housing H, the retainer 60 will fit into the fixing part 13 of the terminal proper 10. This is the secondary fixing of the female terminal T to the housing H. When this connector C is opposed to a counterpart connector CC and its male terminals TT, TT . . . are inserted into the female terminals T, T . . . , each leaf spring 20 will press to contact a male terminal TT to make mechanical connections and electric connections between both connectors C, CC (the state shown in FIG. 1).

In that case, as the front half. of the terminal proper 10 is formed into an approximately box-shaped form, the front half is hardly deformed and the leaf spring 20 inside the front half is reliably protected. Moreover, as the bead 22 is formed on the leaf spring 20, the flexural rigidity of the leaf spring 20 is greater and a sufficient contacting force is provided without provision of a reinforcing spring. Further, as no reinforcing spring is provided and there is no round part, the female terminal T is compactified in directions of height and width. As no reinforcing spring is used, the spring constant has no point of inflection, and the contacting force of each product is stabilized. Furthermore, as the flexural rigidity of the leaf spring 20 is greater, a sufficient contacting force is generated even if a contacting part of the leaf spring 20 is shifted forward close to the port. As a result, the length of insertion of the male terminal TT is shortened, and in turn, the housing HH of the counterpart connector CC that contains the male terminal TT is shortened and compactified and the tolerance to slant of the male terminal TT is also increased. This reduces troubles that a male terminal TT can not be inserted into a female terminal T. Thus the yield of connectors CC can be improved. Moreover, as the leaf spring 20 is formed from the inner upper wall 18, the developed shape is smaller in comparison with a case where a leaf spring is provided independently. Thus the efficiency of layout of developed shapes is higher and the cost is lower, and as bending steps dedicated to the leaf spring are eliminated, the production process is simplified.

As the outer upper wall 19 and the front inner upper wall 18*b* overlap with each other above and below, any load will be borne simultaneously by both the upper walls 19, 18*b*. Thus the front half is hardly deformed, and the leaf spring 20 inside will be protected reliably.

When a guide 15 is provided, the guide 15 fixes the front end of the inner upper wall 18, makes it hard to deform the front half of the terminal proper 10, and protects the leaf spring 20 from damages.

When the root end of the leaf spring 20 is fixed to another wall, the positional accuracy and supporting force of the leaf spring 20 will be improved, and in turn, the quality of the female terminal T will be enhanced.

When the stabilizer 30 is provided at the top end of the terminal proper 10, if the female terminal T is inserted into a chamber 51 of the housing H in a wrong orientation, the stabilizer 30 will catch on the entrance of the chamber 51 in the initial stage of insertion. Thus inverse insertion of the female terminal T is prevented reliably, and any damage to the housing H due to incorrect operation of the worker can be avoided. Furthermore, when the test window 54 that directly leads to the stabilizer 30 is opened in the front of the housing H, if a test jig of which shape is identical to that of the male terminal TT is inserted into the test window 54, the test jig will contact the stabilizer 30. Thus a continuity test, etc. can be made without giving any damage to the leaf spring, etc. When a face set in the direction of width is formed on the stabilizer 30, the lance 53 of the housing H is flexed in the direction of width as the stabilizer 30 advances. Thus the housing H does not require any space for flexing in the direction of height, and the housing H is reduced in its height. As a result, in combination with the use of a single leaf spring 20, the connector C is more compactified in the direction of height. In particular, in the connector C wherein chambers 51 are arranged in the direction of height, several female terminals T are arranged in succession in the direction of height, and the number of walls between chambers 51 is larger. When the height of each female terminal T is lowered and the walls between chambers 51 are made thinner, the connector C can be compactified significantly in the direction of height. Because of this, the connector C is suitable, for example, as a connector for automobiles in which higher space utility is rigorously demanded. When the stabilizer 30 is provided on the lower side of the terminal proper 10, the groove 52 is made downward from the chamber 51 and the lance 53 is provided to flex in the groove in the direction of width of the chamber 51, the connector C can be compactified in the direction of height just like the above-mentioned first embodiment.

As the leaf spring 20 is formed from the inner upper wall 18, even if the leaf spring 20 is deformed, it will rest on the outer upper wall 19 and will not be deformed further. Thus the leaf spring 20 can be prevented from excessive deformation.

When a female terminal T is formed by bending a developed form shown in FIG. 8, as the folding lines are longitudinal except the folding parts of the guide 15, directions of bending are mostly identical, contributing to simplification of the production process. Moreover, when dimples 16*a*, 23, etc. are to be treated by gold-plating, etc., it is sufficient to give the treatment on one side, and this also contributes to simplification of the production process.

The present invention includes embodiments wherein no dimples 16*a*, 23 are provided. When these dimples 16*a*, 23 are provided, even if the slant direction of a male terminal TT changes a little due to thermal deformation caused by a temperature change, the positions of the above-mentioned contacting points do hardly change, and in turn, microsliding wear hardly takes place. Hence imperfect contact due to oxide film hardly occurs. This means a high durability in, for example, an area of harsh temperature changes. In this case, as there is no need of taking microsliding wear preventive measures, such as excessively increasing the contacting force of the leaf spring 20, the force required for connecting the connector C can be set adequately and workability can be enhanced. Moreover, a connector C with a large number of terminals can be set.

Figure 15:
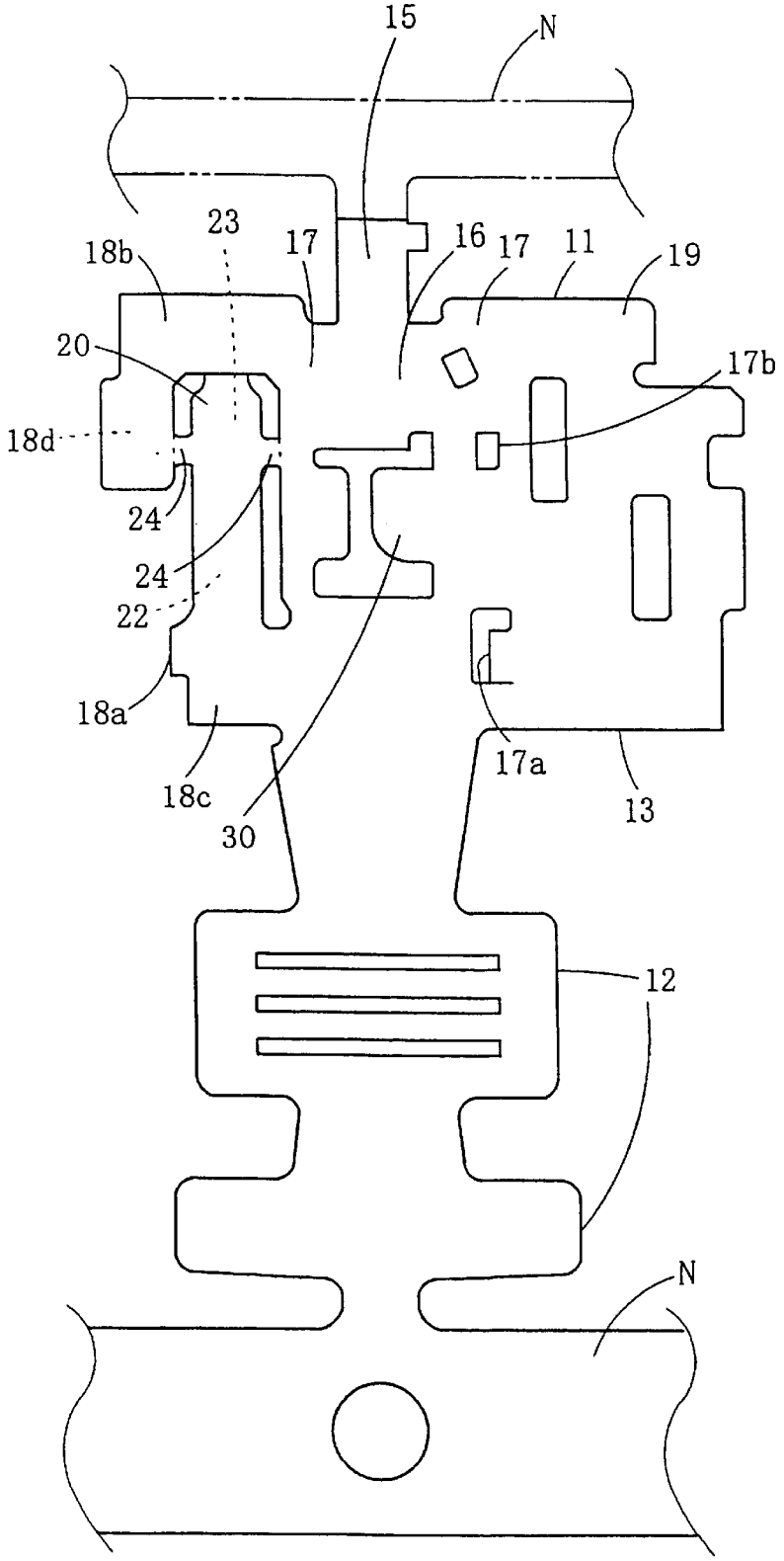
FIG. 15 is a reduced diagram showing the development of the terminal of the second embodiment. The diagram shows the terminal before bending.
Figure 16:
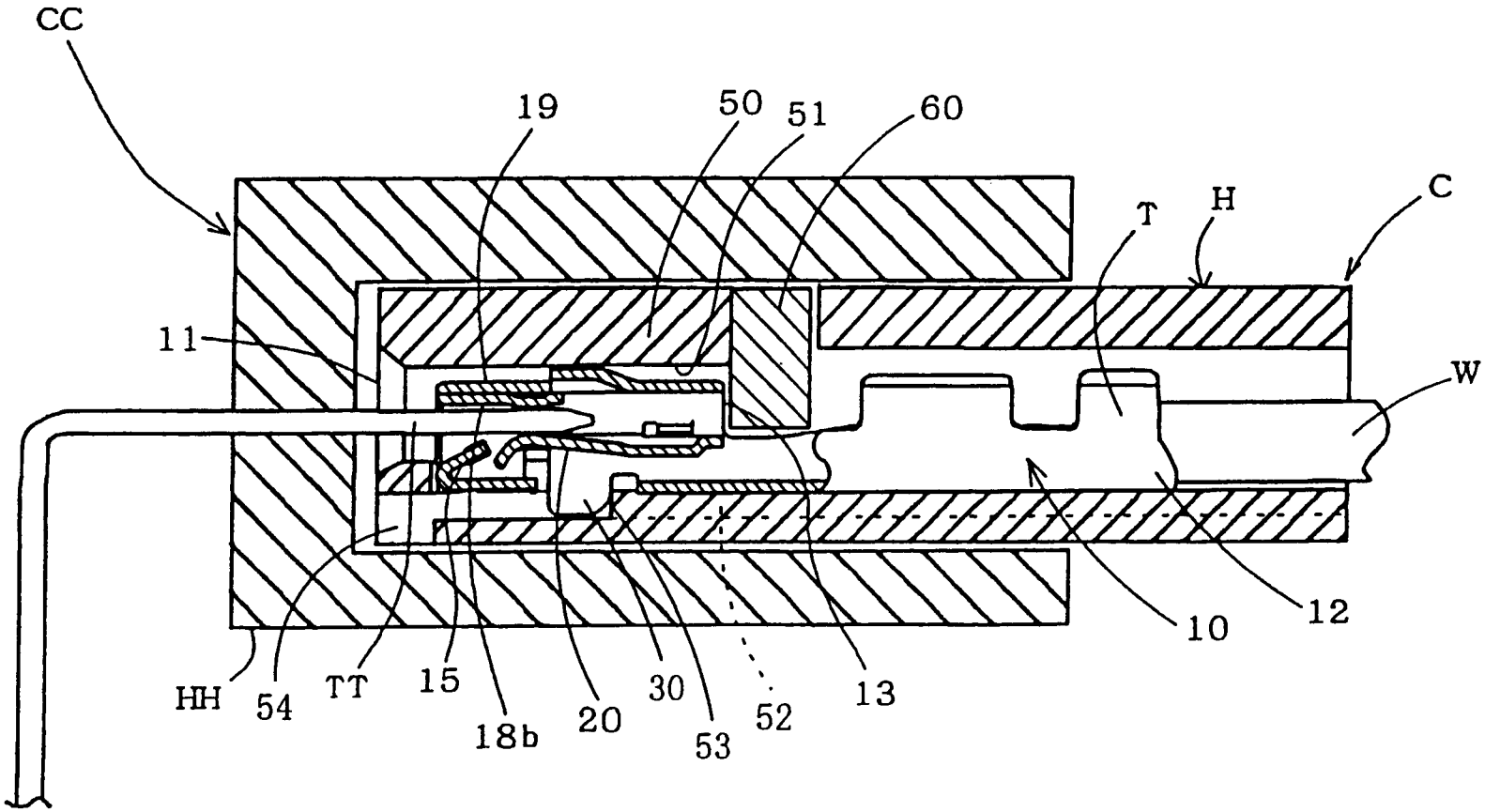
FIG. 16 is a fragmentary vertical sectional view showing a connector of the second embodiment being connected with a counterpart connector.
Figure 17A:
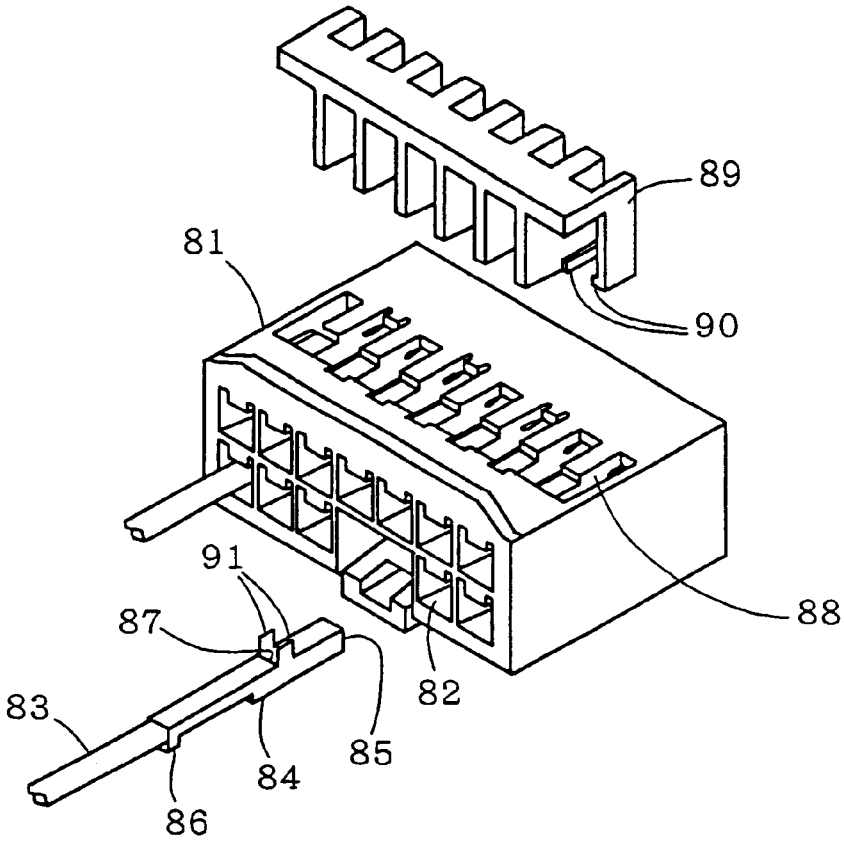
FIG. 17A Prior art
FIG. 17A is a perspective view showing insertion of a conventional female terminal into a housing.
Figure 17B:
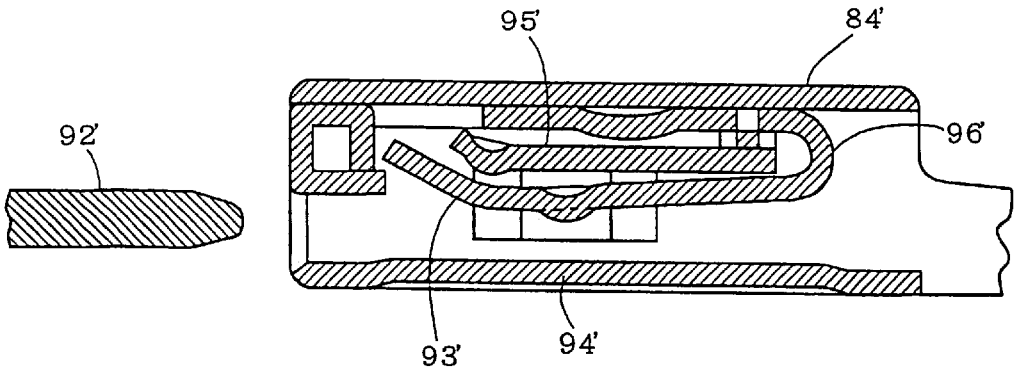
FIG. 17B Prior art
FIG. 17B is a vertical sectional view of another conventional female terminal before insertion of a male terminal.
Figure 17C:
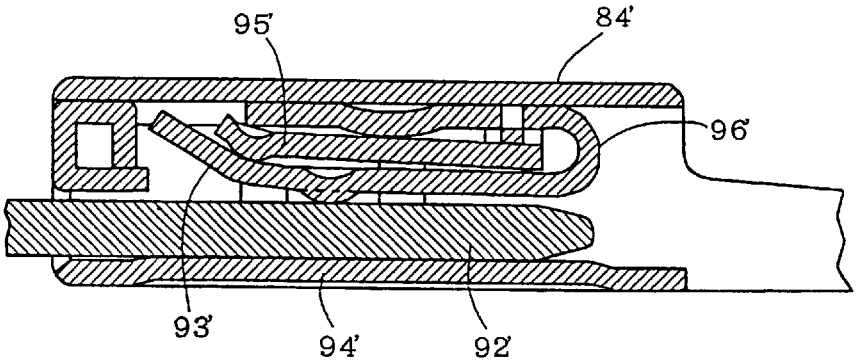
FIG. 17C Prior art
FIG. 17C is a vertical sectional view of the conventional female terminal after insertion of the male terminal.

FIG. 10 through FIG. 15 show a female terminal T of a connector C of the second embodiment. FIG. 16 shows the connector C wherein this female terminal T is inserted in a housing H. This female terminal T is provided with a terminal proper 10 having an approximately box-shaped front half that can be inserted into a chamber 51 of the housing H, a leaf spring 20 of which root end is integral to the front half of the terminal proper 10, and a stabilizer 30 being on the outer side of the terminal proper 10. A port 11 is opened in the front end of the terminal proper 10 to receive a male terminal TT, and a splicing part 12 for connecting an electric wire W is provided in the back thereof. A longitudinally intermediate part of the terminal proper 10 is provided with a fixing part 13 into which a retainer 60 of the housing H is to be fitted.

The front half of the terminal proper 10 is provided with a bottom wall 16, side walls 17, 17 rising from both edges in the width direction of the bottom wall 16, and an outer upper wall 19 and an inner upper wall 18 extending from the upper edges of the respective side walls 17, 17 towards the upper edges of the respective opposing side walls 17, 17. The inner upper wall 18 is provided with a front inner upper wall 18*b* and a rear inner upper wall 18*b*, and the outer upper wall 19 and the front inner upper wall 18*b* overlap with each other, above and below. The rear inner upper wall 18*c* is formed to be lower than the front inner upper wall 18*b*, and a male terminal TT of a counterpart connector is to be inserted into a space between the leaf spring 20 and the front inner upper wall 18*b*. As a modification of this embodiment, it may be arranged that a male terminal TT be inserted into a space between the leaf spring 20 and the outer upper wall 19. The outer upper wall 19 extends from the upper edge of one side wall 17 towards the upper edge of the other side wall 17, and the rear of the outer upper wall 19 corresponding to the rear inner upper wall 18*c* first extends horizontally from the upper edge of the side wall 17, then bends downward and heads towards the upper edge of the opposing side wall 17. The front end of the bottom wall 16 is bent inward to the terminal proper 10 to form a guide 15. This guide 15 prevents inadvertent insertion of a male terminal TT, a screwdriver for inspection, etc. into a gap between the top end of the leaf spring 20 and the inner wall of the terminal proper 10.

The top end of the above-mentioned leaf spring 20 extends forward inside the front half of the terminal proper 10 and can be flexed in the height direction. When a male terminal TT is inserted, the top end of the leaf spring 20 will be below the male terminal TT and be pressed to contact the male terminal TT. The above-mentioned leaf spring 20 is formed by separating the rear inner upper wall 18*c* from the side wall 17, with the rear end of the rear inner upper wall 18*c* being left intact. This leaf spring 20 may be made to have the full width of the rear inner upper wall 18*c* or a portion of the full width in the direction of the width. A bead 22 that has a curved section to increase the flexural rigidity is formed on the leaf spring 20. Examples of the sectional forms of the above-mentioned bead 22 include approximately U-shaped form shown in the diagrams, approximately V-shaped form, approximately W-shaped form and their inverted forms. What is important is that when the leaf spring 20 is sectioned along a plane in the front-rear direction the moment of inertia of area along a neutral axis passing sidewise in the middle, in the thickness direction, of the leaf spring 20 is greater than that of a flat plate. The bead 22 may be formed over a part of the leaf spring 20 as illustrated or over approximately the entire length thereof. Further, the bead 22 may be formed into a dimple as illustrated or a groove or a combination of these forms. The root end of the leaf spring 20 is fixed to another wall. A thrusting piece 18*a* is formed on the side end of the rear of the inner upper wall 18 constituting the root end of the leaf spring 20, and this thrusting piece 18*a* is fit into a hole 17*a* that is opened in the opposing side wall 17. Protrusions 24 are formed on both left and right edges of the top end of the leaf spring 20. These protrusions 24 are fit into receiving holes 17b that are formed in side walls 17, leaving a gap that allows the leaf spring 20 to deform downward at least by a specified amount. When the leaf spring 20 is deformed greatly, the leaf spring 20 will be held by the side walls 17 via the protrusions 24. Thus the leaf spring is prevented from excessive deformation.

When the terminal proper 10 is inserted into a chamber 51 of a housing H of which structure is similar to that described in the first embodiment, the above-mentioned stabilizer 30 will fit into a groove 52 that is formed in the front-rear direction and moves forward beyond a lance 53 that is formed in the groove 52. The stabilizer 30 will reach a position in front of the lance 53 and will be fixed there by the lance 53. The stabilizer 30 having a face in the width direction is erected in the height direction at the front end of the terminal proper 10. In this second embodiment, the stabilizer 30 is provided on the lower side of the terminal proper 10, but it may be provided on the upper side thereof.

The female terminal T is formed from a single sheet metal. As shown in FIG. 15, plural female terminals T, T . . . in a developed form, with a runner N connecting them together, are blanked out of a sheet metal. Next, various parts are bent to form the female terminals T, T . . . into the final shape. After that, the respective female terminals T are separated from the runner N. Protrusions 24, which are formed on both left and right edges of the top end of the leaf spring 20, are not separated from and are integral to the left and right sheet metal portions, namely, a portion that is to constitute the front inner upper wall 18*b* and a portion that is to constitute the side wall 17, in the bending stage. Hence when the leaf spring 20 is subjected to bending to form the bead 22, the dimple 23, etc., tensile forces will evenly work on the leaf spring 20 from both left and right sides, preventing the leaf spring 20 from being bent in one direction. These protrusions 24 are separated from the left and right metal sheet parts after bending of the leaf spring 20.

On the lower side of the front inner upper wall 18*b* of the terminal proper 10 and on the upper side of the leaf spring 20, dimples 18*d*, 23 protruding towards each other are formed respectively to reliably provide contacting parts for the male terminal TT.

The above-mentioned housing H has a structure similar to one described in the first embodiment and as shown in FIG. 16, the housing H comprises a housing proper 50, in which through chambers 51 are formed in the front-rear direction, and a retainer 60 that fits into the housing proper 50 and penetrates into the chambers 51. The above-mentioned housing proper 50 is provided with grooves 52 that are made in the height direction from the chambers 51, extend in the front-rear direction and receive the stabilizers 30, lances 53 that are formed in respective grooves 52 to be flexed in the width direction of the chambers 51 and fix the stabilizers 30 by the front sides, and testing windows 54 that allow access to the grooves 52 in front of the lances 53 from the front side. A modification of this lance 53 may be one that fits into an opening which is formed in the bottom wall 15 of the terminal proper 10 by cutting out and erecting the stabilizer 30. The above-mentioned grooves 52 are formed downward from the chambers 51. Chambers 51 may be arranged parallel in a single row in the width direction. Such rows of chambers 51 may be arranged in several columns in the height direction.

In the above-mentioned second embodiment, after an electric wire W is connected to the splicing part 12 of the terminal proper 10, when the female terminal T is inserted into a chamber 51 of the housing H, the stabilizer 30 will fit into a groove 52 of the housing H, then go beyond a lance 53 of the housing H and be fixed by the lance 53. This is the primary fixing of the female terminal T to the housing H. Next, when the retainer 60 is forced into the housing H, the retainer 60 will fit into the fixing part 13 of the terminal proper 10. This is the secondary fixing of the female terminal T to the housing H. When this connector C is opposed to a counterpart connector CC and its male terminals TT, TT . . . are inserted into the female terminals T, T . . . , each leaf spring 20 will press to contact a male terminal TT to make mechanical connections and electric connections between both connectors C, CC.

In that case, as the front half of the terminal proper 10 is formed into an approximately box-shaped form, the front half is hardly deformed and the leaf spring 20 inside the front half is reliably protected. Moreover, as the bead 22 is formed on the leaf spring 20, the flexural rigidity of the leaf spring 20 is greater and a sufficient contacting force is provided by the single leaf spring 20 without provision of a reinforcing spring. Further, as no reinforcing spring is provided and there is no round part, the female terminal T is compactified in directions of height and width. As no reinforcing spring is used, the spring constant has no point of inflection, and the contacting force of each product is stabilized. Furthermore, as the flexural rigidity of the leaf spring 20 is greater, a sufficient contacting force is generated even if a contacting part of the leaf spring 20 is shifted forward close to the port. As a result, the length of insertion of the male terminal TT is shortened, and in turn, the housing H of the counterpart connector CC that contains the male terminal TT is shortened and compactified and the tolerance to slant of the male terminal TT is also increased. This reduces troubles that a male terminal TT can not be inserted into a female terminal T. Thus the yield of connectors CC can be improved. Moreover, as the leaf spring 20 is formed from the inner upper wall 18, the developed shape is smaller in comparison with a case where a leaf spring is provided independently. Thus the efficiency of layout of developed shapes is higher and the cost is lower, and as bending steps dedicated to the leaf spring are eliminated, the production process is simplified.

As the outer upper wall 19 and the front inner upper wall 18*b* overlap with each other above and below, any load will be borne simultaneously by both the upper walls 19, 18*b*. Thus the front half is hardly deformed, and the leaf spring 20 inside will be protected reliably.

When a guide 15 is provided, the guide 15 protects the leaf spring 20 from damages. In a manner similar to the first embodiment, when the front end of the outer upper wall 19 is bent inward to the terminal proper 10 to conceal the front end of the front inner upper wall 18*a* and form the guide 15, the front end of the inner upper wall 18 is fixed and the front half of the terminal proper 10 becomes more resistant to deformation.

When the root end of the leaf spring 20 is fixed to another wall, the positional accuracy and supporting force of the leaf spring 20 will be improved, and in turn, the quality of the female terminal T will be enhanced.

The stabilizer 30 can prevent inverse insertion of the terminal proper 10. In this case, if the stabilizer 30 is provided at the front end of the terminal proper 10 by erecting the stabilizer 30 from the outer upper wall 19 just like the first embodiment, although this is not used in the above-mentioned second embodiment, if the female terminal T is inserted into a chamber 51 of the housing H in a wrong orientation, the stabilizer 30 will catch on the entrance of the chamber 51 in the initial stage of insertion. Thus inverse insertion of the female terminal T is prevented reliably, and any damage to the housing H due to incorrect operation of the worker can be avoided. Furthermore, when a test window 54 that directly leads to the stabilizer 30 is opened in the front of the housing H, if a test jig of which shape is identical to that of the male terminal TT is inserted into the test window 54, the test jig will contact the stabilizer 30; thus a continuity test, etc. can be made without giving any damage to the leaf spring, etc.

When a face set in the direction of width is formed on the stabilizer 30, the lance 53 of the housing H is flexed in the direction of width as the stabilizer 30 advances. Thus the housing H does not require any space for flexing in the direction of height, and the housing H is reduced in its height. As a result, in combination with the use of a single leaf spring 20, the connector C is more compactified in the direction of height. In particular, in the connector C wherein chambers 51 are arranged in the direction of height, several female terminals T are arranged in succession in the direction of height, and the number of walls between chambers 51 is larger. When the height of each female terminal T is lowered and the walls between chambers 51 are made thinner, the connector C can be compactified significantly in the direction of height. Because of this, the connector C is suitable, for example, as a connector for automobiles in which higher space utility is rigorously demanded. When the stabilizer 30 is provided on the upper side of the terminal proper 10, the groove 52 is made upward from the chamber 51 and the lance 53 is provided to flex in the groove 52 in the direction of width of the chamber 51, the connector C can be compactified in the direction of height just like the above-mentioned first embodiment.

As the leaf spring 20 is formed from the inner upper wall 18, even if the leaf spring 20 is deformed, it will rest on the bottom wall 16 and will not be deformed further. Thus the leaf spring 20 can be prevented from excessive deformation. Further, the present invention includes embodiments wherein the top end of the leaf spring is left open. However, when protrusions 24 are formed on both left and right edges of the top end of the leaf spring 20 and these protrusions are fit into holes 17*b* made in the side walls 17, the leaf spring 20 can be prevented from excessive deformation. Moreover, although this is not to limit the working method of the present invention, when protrusions 24 of the leaf spring 20 are to be separated from the left and right metal sheet parts only after bending, the leaf spring 20 can be prevented from bending in one direction.

When a female terminal T is formed by bending a developed form shown in FIG. 15, as the folding lines are longitudinal, directions of bending are mostly identical, contributing to simplification of the production process.

The present invention includes embodiments wherein no dimples 18*d*, 23 are provided. When these dimples 18*a*, 23 are provided, even if the slant direction of a male terminal TT changes a little due to thermal deformation caused by a temperature change, the positions of the above-mentioned contacting points do hardly change, and in turn, microsliding wear hardly takes place. Hence imperfect contact due to oxide film hardly occurs. This means a high durability in, for example, an area of harsh temperature changes. In this case, as there is no need of taking microsliding wear preventive measures, such as excessively increasing the contacting force of the leaf spring 20, the force required for connecting the connector C can be set adequately and workability can be enhanced. Moreover, a connector C with a large number of terminals can be set.

If the front end of the leaf spring 20 is forked into two, three or more branches, the contacting parts will increase in number, and the number of contacting parts with the male terminal TT will increase. Thus this forking is effective as a measure for preventing imperfect contact and as a measure for preventing microsliding wear. In such a case, it is desirable to provide a bead for each branch of the front end and dimples 16*a* (18*d*), 23.

In the respective embodiments of a female terminal and a housing therefor described above, the stabilizer 30 of the female terminal T is fixed by the lance 53 of the housing H to make the primary fixing, and the retainer 60 is fitted into the fixing part 13 of the terminal proper 10 to make the secondary fixing. In addition to the embodiments of a female terminal and a housing therefor having these double fixing, the present invention includes embodiments of a female terminal and a housing therefor in which only a primary fixing is made. In such a case, a means for fixing may be a so-called housing lance, which is a protruding part provided on a housing and fits into a recess in a female terminal, a so-called contact lance, which is a protruding part provided on a female terminal and fits into a recess in a housing, a retainer, which is fitted into a fixing part in the terminal proper, or a combination of these means. The present invention includes all the embodiments using these means. In addition to the above-mentioned embodiment, the present invention includes an embodiment of a female terminal wherein a gap is present between the outer upper wall and the front inner upper wall, an embodiment of a female terminal wherein no guide is provided and the front end of the outer upper wall is a simple plane, an embodiment of a female terminal wherein the root end of a leaf spring is not fixed to another wall and is cantilevered relative to the side walls, an embodiment of a female terminal wherein no stabilizer is provided, an embodiment of a female terminal wherein a stabilizer is in any direction within a range from the width direction to the height direction, an embodiment of a female terminal wherein each piece is separately blanked out of a sheet metal and not connected to a runner, embodiments wherein the above-mentioned embodiments are combined, and embodiments of a housing therefor.

What is claimed is:

1. A female terminal for a connector that is to be inserted into a chamber of a housing of a connector and is to receive a male terminal, said female terminal comprising:

a terminal proper having a box-shaped front half that can be inserted into said chamber of the housing, having a port that opens in the front end and receives a male terminal, and having a splicing part that is in the back and is to be connected to an electric wire; and only one leaf spring having a root end that is integral to the front half of said terminal proper, having a top end that extends forward inside the front half of said terminal proper, and being flexed in the direction of height, said only one leaf spring including a bead with a curved section to increase the flexural rigidity of said only one leaf spring;

said front half of the terminal proper comprising;

a bottom wall, side walls rising from both ends in the width direction of said bottom wall, and an outer upper wall and an inner upper wall extending from the top edges of said respective side walls toward the top edges of the opposing side walls, said inner upper wall having a front inner upper wall and a rear inner upper wall, wherein said only one leaf spring is formed by separating said rear inner upper wall from the side wall, with the rear end of said rear inner upper wall being left intact and constituting the only point of contact between the only one leaf spring and the inner upper wall, and an upper surface of said only one leaf spring is out of contact with the outer upper wall.

2. A female terminal for a connector of claim 1 characterized in that said rear inner upper wall is formed at the same height as said front inner upper wall.

3. A female terminal for a connector of claim 1 characterized in that said rear inner upper wall is formed lower than said front inner upper wall.

4. A female terminal for a connector of claim 1 characterized in that said outer upper wall and said front inner upper wall overlap with each other, above and below.

5. A female terminal for a connector of claim 4 characterized in that said rear inner upper wall is formed at the same height as said front inner upper wall.

6. A female terminal for a connector of claim 4 characterized in that said rear inner upper wall is formed lower than said front inner upper wall.

7. A female terminal for a connector of claim 4 characterized in that the front end of said outer upper wall is bent inward to the terminal proper to conceal the front end of said inner upper wall and form a guide.

8. A female terminal for a connector of claim 4 characterized in that the root end of said only one leaf spring is fixed to an opposing side wall.

9. A female terminal for a connector of claim 4 further comprising a stabilizer being erected in the direction of height and having a face in the direction of width on the outer side of the front end of said terminal proper, said stabilizer, when said terminal proper is inserted into a chamber of the housing, will fit into a groove that is formed in the the front-rear direction and move forward beyond a lance that is formed in the groove to be fixed by said lance.

10. A female terminal for a connector of claim 1 characterized in that the front end of said outer upper wall is bent inward to the terminal proper to conceal the front end of said inner upper wall and form a guide.

11. A female terminal for a connector of claim 10 characterized in that the root end of said only one leaf spring is fixed to an opposing side wall.

12. A female terminal for a connector of claim 10 further comprising a stabilizer being erected in the direction of height and having a face in the direction of width on the outer side of the front end of said terminal proper, said stabilizer, when said terminal proper is inserted into a chamber of the housing, will fit into a groove that is formed in the the front-rear direction and move forward beyond a lance that is formed in the groove to be fixed by said lance.

13. A female terminal for a connector of claim 1 characterized in that the root end of said only one leaf spring is fixed to an opposing side wall.

14. A female terminal for a connector of claim 13 further comprising a stabilizer being erected in the direction of height and having a face in the direction of width on the outer side of the front end of said terminal proper, said stabilizer, when said terminal proper is inserted into a chamber of the housing, will fit into a groove that is formed in the the front-rear direction and move forward beyond a lance that is formed in the groove to be fixed by said lance.

15. A female terminal for a connector of claim 1 further comprising a stabilizer being erected in the direction of height and having a face in the direction of width on the outer side of the front end of said terminal proper, said stabilizer, when said terminal proper is inserted into a chamber of the housing, will fit into a groove that is formed in the the front-rear direction and move forward beyond a lance that is formed in the groove to be fixed by said lance.

16. A housing of a connector into which a female terminal for a connector of claim 15 is inserted, said housing comprising said chambers penetrating in the front-rear direction, grooves that are made in the height direction from said chambers, extend in the front-rear direction and receive said stabilizers, lances that are formed in said grooves to be flexed in the width direction of said chambers and fix said stabilizers by the front sides, and test windows that allow access to said grooves in front of said lances from the front side.

17. A female terminal for a connector that is to be inserted into a chamber of a housing of a connector and is to receive a male terminal, said female terminal comprising:

a terminal proper having a box-shaped front half that can be inserted into said chamber of the housing, having a port that opens in the front end and receives a male terminal, and having a splicing part that is in the back and is to be connected to an electric wire;

only one leaf spring having a root end that is integral to the front half of said terminal proper, having a top end that extends forward inside the front half of said terminal proper, and being flexed in the direction of height;

said front half of the terminal proper comprising a bottom wall, a first side wall bent at right angle with said bottom wall at an end in the width direction of said bottom wall, a second side wall bent at a right angle with said bottom wall at an opposing end in the width direction of said bottom wall, an inner upper wall bent at right angle with said first side wall at a top end of said first side wall and said inner upper wall having a front inner upper wall and a rear inner upper wall, and an outer upper wall bent at right angle with said second side wall at a top end of said second side wall to cover said inner upper wall, said only one leaf spring being formed by separating said rear inner upper wall from the first side wall, with the rear end of said rear inner upper wall being left intact and constituting the only point of contact between said only one leaf spring and the inner upper wall and said only one leaf spring being out of contact with said outer upper wall, and said only one leaf spring having a bead with a curved section to increase the flexural rigidity.

18. The female terminal for a connector according to claim 1, wherein said root end of said only one leaf spring has two sides, one side of the root end of said only one leaf spring is integral to said first side wall and an opposing side of the root end of the only one leaf spring is retained and engaged with said second side wall.

19. A female terminal for a connector that is to be inserted into a chamber of a housing of a connector and is to receive a male terminal, said female terminal comprising:

a terminal proper having a box-shaped front half that can be inserted into said chamber of the housing, having a port that opens in the front end for receiving a male terminal, and having a splicing part that is in the back for connecting to an electric wire;

said front half of the terminal proper comprising;

a bottom wall, side walls rising from both ends in the width direction of said bottom wall, an outer upper wall and an inner upper wall extending from the top edges of said respective side walls toward the top edges of the opposing side walls, said inner upper wall having a front inner upper wall and a rear inner upper wall, and a leaf spring having a root end integral with said rear inner upper wall and said leaf spring being separated from said front inner upper wall and said side walls along a length of said leaf spring such that a top end of said leaf spring is positioned between said sidewalls, said leaf spring including a longitudinally extending bead and a curved section;

wherein an apex of said bead commences at an inner most portion of said leaf spring with legs of said bead extending toward respective top edges of the opposing side walls for increasing a flexural rigidity of said leaf spring.

* * * * *